US005993300A

United States Patent [19]

Hashimoto

[11] Patent Number: 5,993,300

[45] Date of Patent: Nov. 30, 1999

[54] ULTRASONIC VIBRATION COMPOSITE PROCESSING TOOL

[76] Inventor: Hiroshi Hashimoto, 1117-12, Hinata, Isehara, Japan

[21] Appl. No.: 09/026,073

[22] Filed: Feb. 19, 1998

[51] Int. Cl.[6] ..... B24B 7/00

[52] U.S. Cl. ..... 451/165; 451/178; 451/362; 451/910

[58] Field of Search ..... 451/178, 362, 451/910, 165

[56] References Cited

U.S. PATENT DOCUMENTS

| | | | |
|---|---|---|---|
| 2,452,211 | 10/1948 | Rosenthal | 451/37 |
| 2,468,550 | 4/1949 | Fruth | 451/910 |
| 5,655,956 | 8/1997 | Ferreira et al. | 451/143 |
| 5,733,074 | 3/1998 | Stock et al. | 451/165 |

FOREIGN PATENT DOCUMENTS

| | | |
|---|---|---|
| 203963 | 2/1995 | Japan . |

*Primary Examiner*—David A. Scherbel
*Assistant Examiner*—Shantese McDonald
*Attorney, Agent, or Firm*—Steinberg & Raskin, P.C.

[57] ABSTRACT

An ultrasonic vibration composite processing tool is disclosed wherein at least one small-sized processing member is arranged for carrying out processing of a processed material while applying vibration to the processed material, to thereby ensure stable operation of the processing tool to accomplish efficient processing of the processed material even when the processed material is large-sized. A processing structure and a vibration structure are arranged. The processing structure includes a rotatable base having a rotation axis and at least one processing member including a micro-cutting surface. The processing member is arranged on one surface of the base so as to be positioned in a circumferential direction of the base about the rotation axis of the base. The vibration structure functions to vibrate the processing member in directions of the processed material.

14 Claims, 19 Drawing Sheets

ULTRASONIC VIBRATION COMPOSITE PROCESSING TOOL

BACKGROUND OF THE INVENTION

This invention relates to a processing tool for processing a material to be processed (hereinafter referred to as "processed material") represented by a hard and brittle material (hereinafter referred to as "brittle material") such as glass or ceramic, a metal material, or the like, and more particularly to an ultrasonic vibration composite processing tool for carrying out processing of a processed material by grinding, polishing, cutting or the like while applying vibration to the processed material during processing of the processed material.

In order to ensure satisfactory processing of a processed material such as a brittle material, a metal material or the like into a predetermined or desired size by infeed and permit a surface of the processed material which has been subject to processing to exhibit properties of a desired level, it is required to reduce processing force which is applied to the processed material during the processing, to thereby permit a processing member to exhibit a satisfactory processing performance, resulting in eliminating dressing as much as possible when the processing member is, for example, a grinding wheel.

In general, when a vibrator is used to apply vibration to a processing member, an increase in diameter of the processing member to a degree as large as, for example, 100 mm or more renders smooth processing substantially impossible. This causes advantages such as a reduction in processing force and the like obtained due to the vibrator to be lost.

A substrate such as a glass substrate for a liquid crystal display device, a glass substrate for a plasma display device, a glass substrate for a thermal head, a ceramic substrate for a hybrid IC or the like tends to be increased in size with the years. Unfortunately, a processing tool for uniformly processing a surface of the substrate at an increased speed has not been developed in the art.

SUMMARY OF THE INVENTION

In view of the foregoing disadvantage of the prior art, the inventor made both an effort and a study to develop a processing tool capable of effectively processing a material of a relatively increased size. As a result, it was found that the disadvantage of the prior art can be effectively eliminated by an ultrasonic vibration composite processing tool which is so constructed that at least one processing member of a reduced size having a micro-cutting surface is arranged on one surface of a rotatable base having a rotation axis so as to be positioned in a circumferential direction of the base about a rotation axis of the base, to thereby provide a processing means and a vibration means is arranged for vibrating the processing member in directions of a processed material, whereby composite processing of the processed material is carried out while applying vibration to the material and ensuring that both feed and discharge of processing liquid are satisfactorily attained during processing.

Accordingly, it is an object of the present invention to provide an ultrasonic vibration composite processing tool in which at least one small-sized processing member is arranged for processing a processed material while applying ultrasonic vibration thereto, to thereby permit the processed material to be efficiently processed by stable operation even when the processed material is increased in size.

It is another object of the present invention to provide an ultrasonic vibration composite processing tool which is capable of attaining processing of a flat portion of a processed material into a predetermined or desired size by infeed and minimizing generation of a surface defect such as a crack, a pit or the like on a processed surface or a surface of the processed material which has been processed to provide the processed surface with satisfactory surface properties, as well as ensuring processing of the processed material with highly increased accuracy even when it is large-sized.

It is a further object of the present invention to provide an ultrasonic vibration composite processing tool which is capable of keeping both tangent processing force and normal processing force at a substantially constant level during processing, reducing both tangent processing force and abrasion of a micro-cutting surface to a degree sufficient to eliminate dressing, and ensuring processing of a processed material Into a predetermined or desired size by infeed.

In accordance with the present invention, an ultrasonic vibration composite processing tool is provided. The ultrasonic vibration composite processing tool includes a processing means including a base arranged in a rotatable manner and at least one processing member. The base has a rotation axis and is arranged so as to be rotatable about the rotation axis. The processing member has a micro-cutting surface and is arranged on one surface of the base so as to be positioned in a circumferential direction of the base about the rotation axis of the base. The ultrasonic vibration composite processing tool also includes a vibration means for vibrating the processing member in directions of a processed material. The processed material is subject to composite processing while being exposed to vibration during processing.

In a preferred embodiment of the present invention, the processing means includes a plurality of the processing members, which are formed into an identical configuration and arranged on the one surface of the base in a manner to be spaced from each other at predetermined intervals about the rotation axis of the base in a circumferential direction of the base.

In a preferred embodiment of the present invention, the base is supportedly mounted on a revolving shaft and the vibration means is interposedly arranged between the processing member and the base.

In a preferred embodiment of the present invention, the base is supportedly mounted on a revolving shaft and the vibration means is interposedly arranged between the processing member and the base. In the embodiment, the ultrasonic vibration composite processing tool further includes a first drive motor for rotatably driving the revolving shaft, a second drive motor for rotatably driving the processing member, and a bearing interposedly arranged between the base and the processing member.

In a preferred embodiment of the present invention, the processing member includes a base member connected to the vibration means and the micro-cutting surface formed on a lower surface of said base member.

In a preferred embodiment of the present invention, the micro-cutting surface is formed by embedding an ultra-hard abrasive grain in the lower surface of the base member, wherein the ultra-hard abrasive grain has a grain size between a coarse grain size and submicrons and is selected from the group consisting of a diamond abrasive grain and a CBN abrasive grain.

In a preferred embodiment of the present invention, the vibration means includes an ultrasonic vibrator interposedly arranged between the processing member and the base to subject the processing member to ultraviolet vibration in the directions of the processed material and a horn for amplifying a vibration amplitude of the ultrasonic vibrator.

In a preferred embodiment of the present invention, the revolving shaft and base are formed therein with a processing liquid guide hole in a manner to commonly extend through a center of both revolving shaft and base, resulting in processing liquid being fed through the processing liquid guide hole.

In a preferred embodiment of the present invention, the micro-cutting surface of the base member of the processing member is formed thereon with grooves in a manner to be spaced from each other at equal intervals.

In a preferred embodiment of the present invention, the micro-cutting surface is formed on only a part of the lower surface of the base member.

In a preferred embodiment of the present invention, the processing member is formed into a curved strip-like shape defined between arcs of radii different from each other about an axis of the base.

The ultrasonic vibration composite processing tool of the present invention thus constructed revolves the base and processing member to provide a cutting blade while feeding processing liquid to a processed portion of a processed material and simultaneously subjects the processing member to ultrasonic vibration in the processing directions of the processed material.

BRIEF DESCRIPTION OF THE DRAWINGS

These and other objects and many of the attendant advantages of the present invention will be readily appreciated as the same becomes better understood by reference to the following detailed description when considered in connection with the accompanying drawings; wherein.

DETAILED DESCRIPTION OF THE PREFERRED EMBODIMENTS

Figure 1:
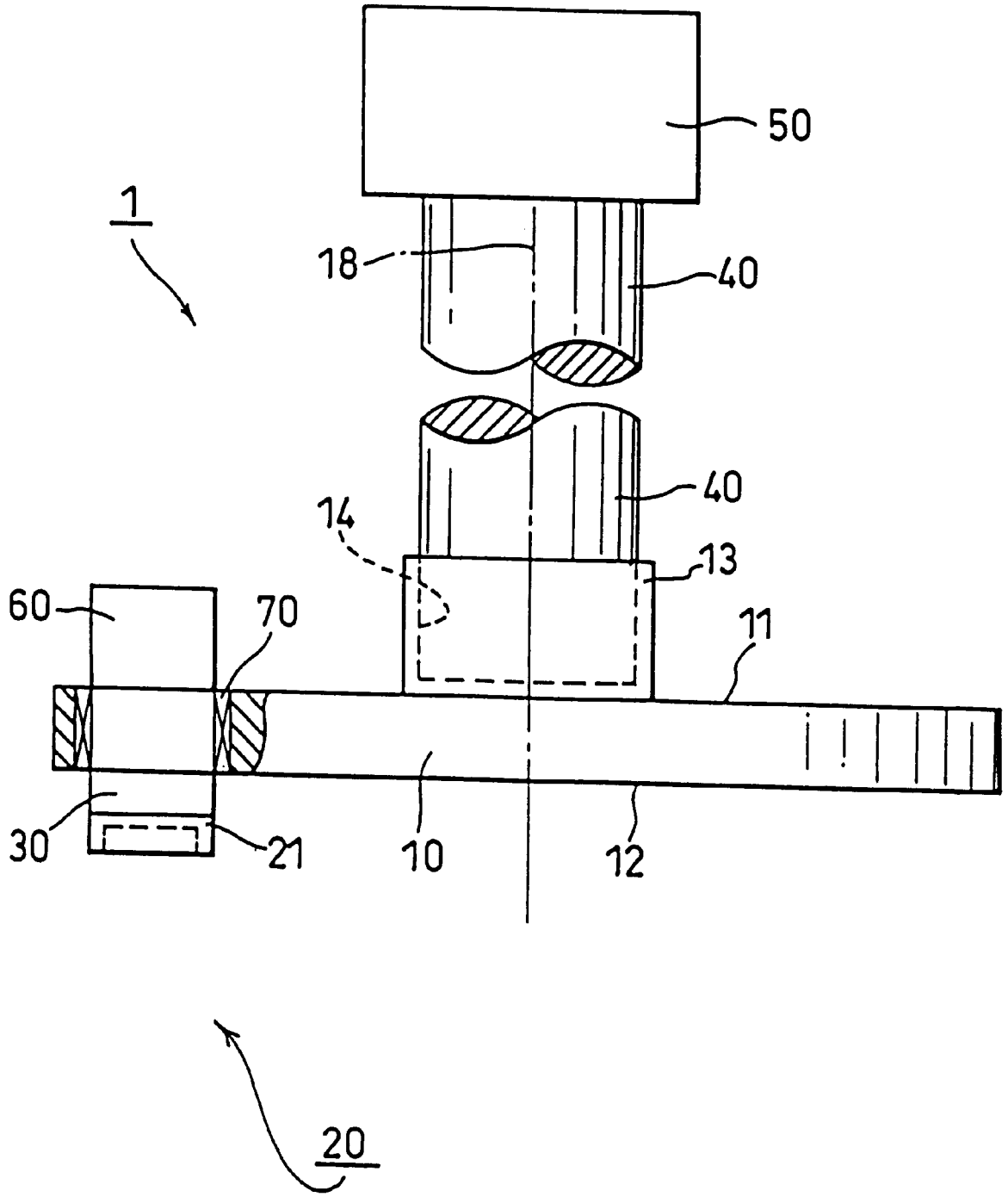
FIG. 1 is a front elevation view showing an embodiment of an ultrasonic vibration composite processing tool according to the present invention, which includes a single processing member.
Figure 2:
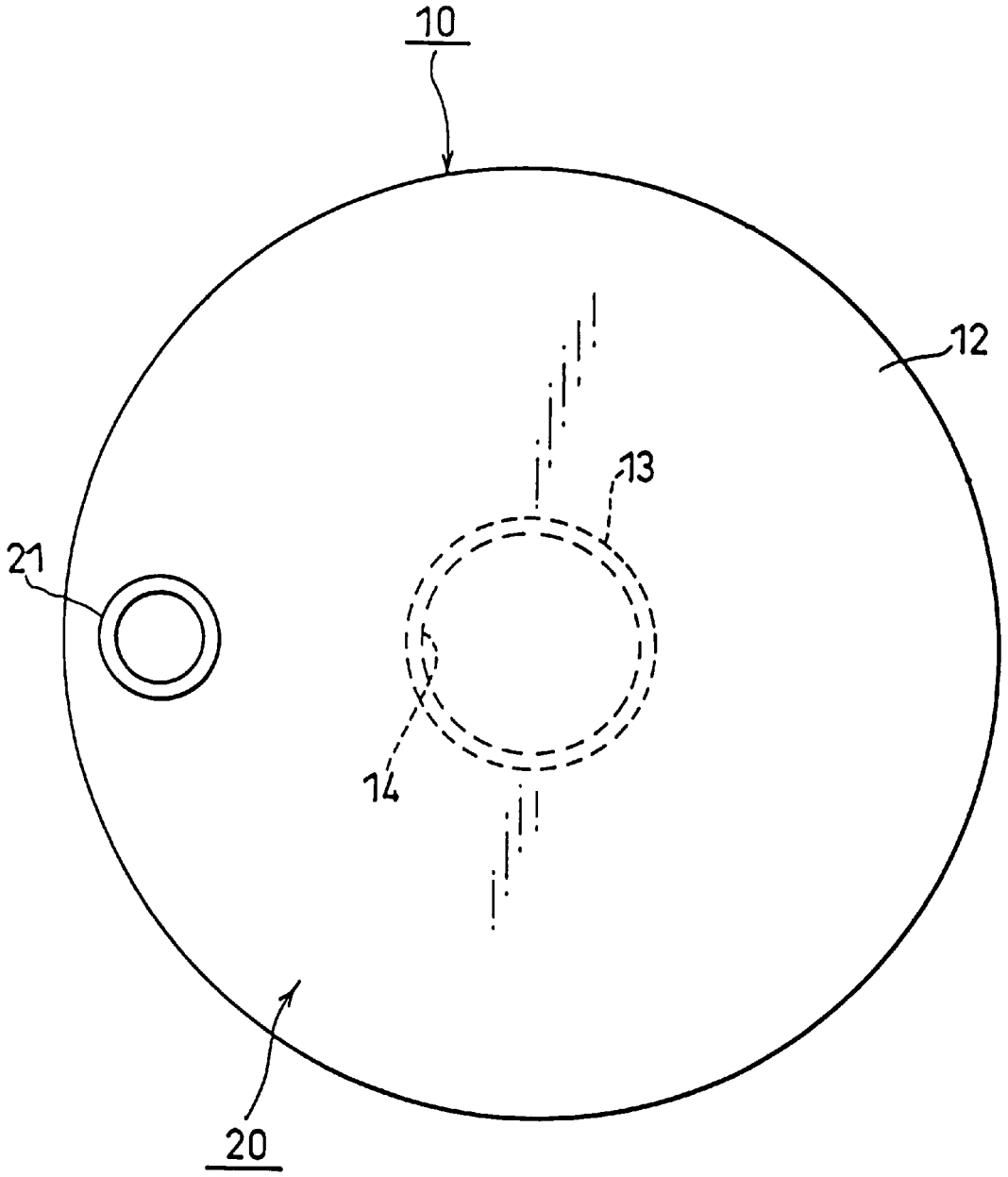
FIG. 2 is a bottom view of the ultrasonic vibration composite processing tool shown in FIG. 1.

Now, an ultrasonic vibration composite processing tool according to the present invention will be described hereinafter with reference to the accompanying drawings.

Referring first to FIGS. 1 to 10, a first embodiment of an ultrasonic vibration composite processing tool according to the present invention is illustrated. An ultrasonic vibration composite processing tool of the illustrated embodiment which is generally designated at reference numeral 1 is constructed so as to permit a processing member to rotate on an axis thereof and revolve around an axis of a base when the base and processing member are rotated independently from each other. For this purpose, the ultrasonic vibration composite processing tool 1 which is adapted to carry out composite processing of a processed material while applying vibration to the processed material generally includes a base 10 arranged in a manner to be rotatable manner, a processing means 20 including at least one processing member 21, and a vibration means 30. More particularly, the processing means 20 of the processing tool 1 shown in FIGS. 1 and 2 includes a single processing member 21 and the processing means 20 of the processing tool 1 shown in FIGS. 3 and 4 includes a plurality of processing members 21.

The base 10 has a rotation axis 18 and is arranged so as to be rotated about the rotation axis 18. The base 10 is made of a material such as a steel plate or the like which is capable of exhibiting rigidity sufficient to keep the base 10 from being deformed by processing force. The base 10 may be formed into a disc-like shape of about 100 to 400 mm in diameter.

Figure 3:
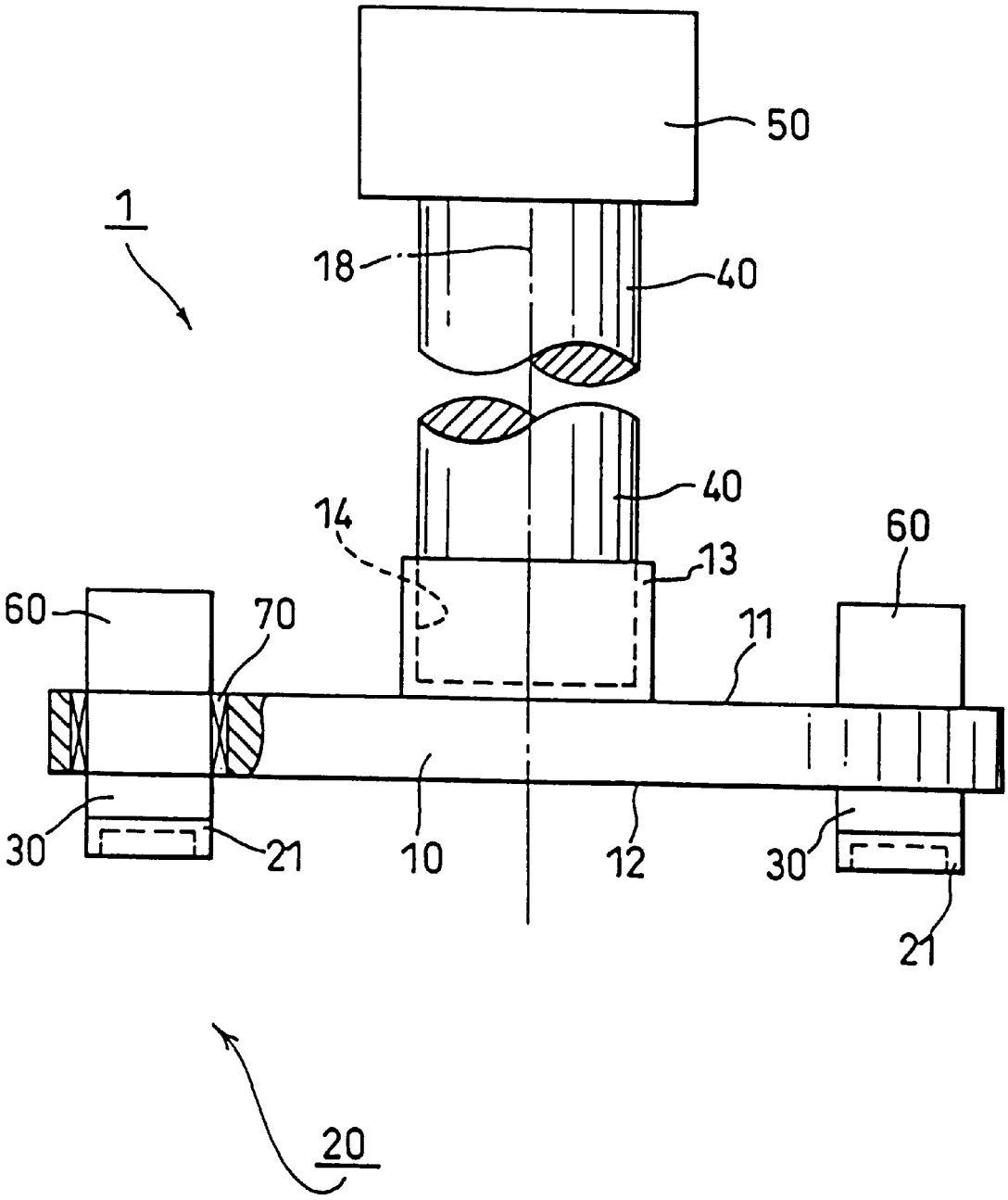
FIG. 3 is a front elevation view showing a variation of the ultrasonic vibration composite processing tool of FIG. 1, which includes a plurality of processing members.
Figure 4:
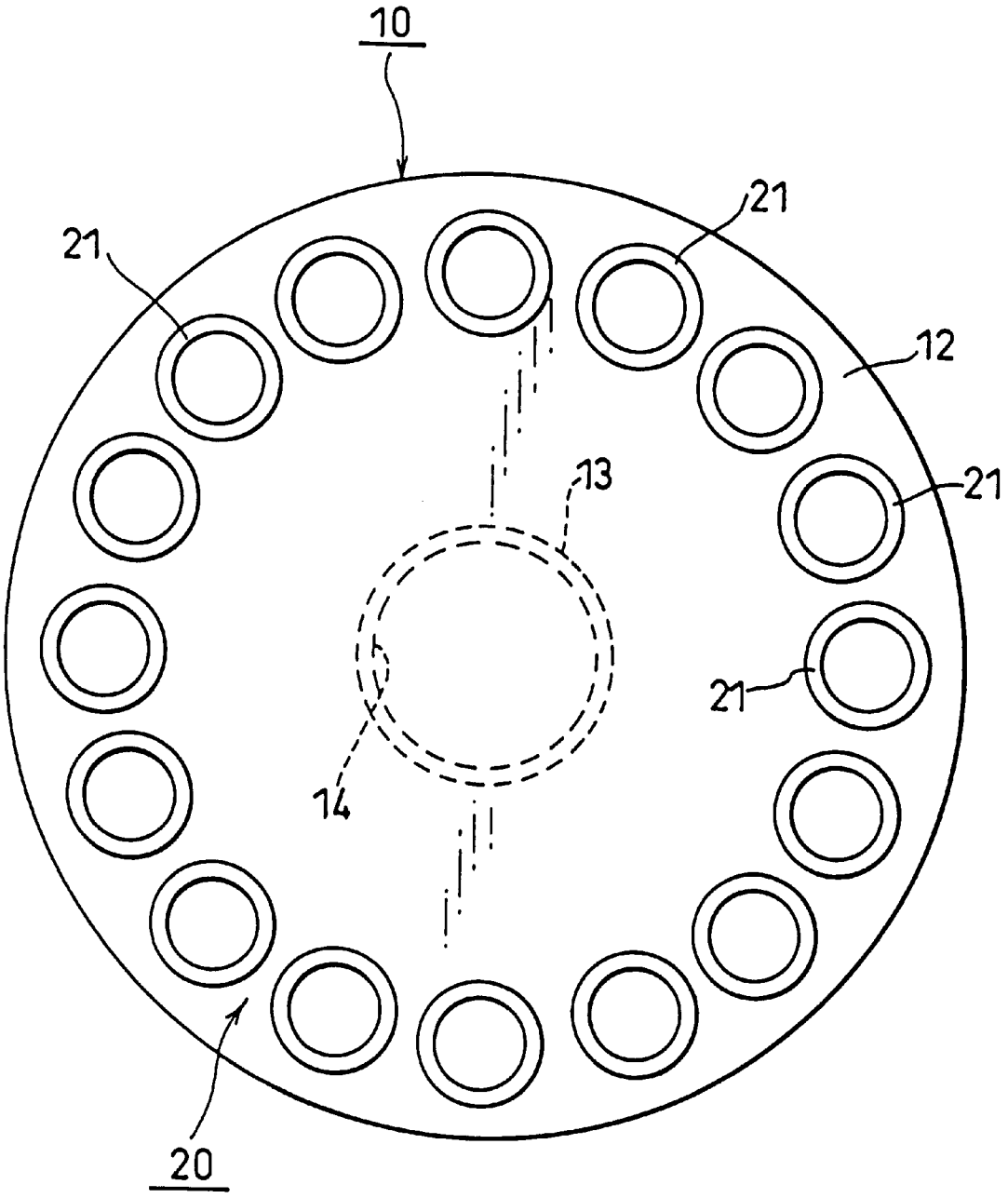
FIG. 4 is a bottom view of the ultrasonic vibration composite processing tool shown in FIG. 3.
Figure 5:
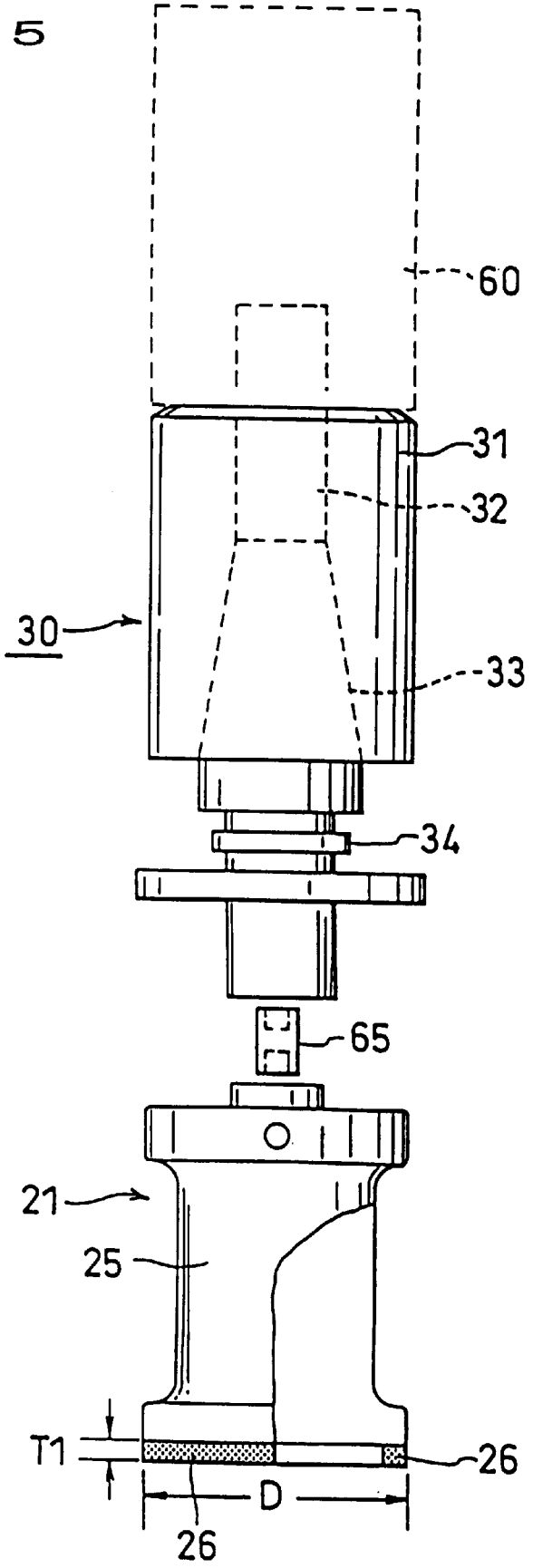
FIG. 5 is an exploded front elevation view showing a vibration means and a processing member incorporated in an ultrasonic vibration composite processing tool according to the present invention.

The base 10 is provided on a central portion of one surface 11 thereof which is an upper surface thereof in FIGS. 1 and 3 with a connection cylinder 13 arranged so as to mount a revolving shaft 40 thereon. The connection cylinder 13 is formed on an inner peripheral surface thereof with female threads 14, which are threadedly fitted on male threads formed on an outer periphery of a proximal end portion of the revolving shaft 40 rotatably driven by a first drive motor 50.

The processing means 20, as described above, includes at least one processing member 21. More specifically, the processing tool 1 of FIGS. 1 and 2 includes the single processing member 21 arranged on one surface 12 of the base 10 or a lower surface thereof in FIG. 3 so as to be positioned in a circumferential direction of the base about the rotation axis of the base 10. The processing tool 1 of FIGS. 3 and 4 includes a plurality of the processing members 21 formed into the same configuration and arranged on the one surface 12 of the base 10 in a manner to be spaced from each other at predetermined intervals about the rotation axis of the base 10 in a circumferential direction of the base 10.

The processing member 21 each include a base member 25 made of a heat-resistant material and connected to the vibration means 30 by means of a set screw 65 (FIG. 5), as well as a micro-cutting surface 26 formed on a lower surface of the base member 25. In the processing tool 1 shown in FIG. 3, the processing members 21 are arranged at equal intervals on the one or lower surface 12 of the base 10.

The micro-cutting surface 26 is formed into a thickness T1 (FIG. 5) of about 1 to 3 mm by embedding an ultra-hard abrasive grain having a grain size between a coarse grain size (hundreds of microns) and submicrons in the lower surface 12 of the base member 25. The ultra-hard abrasive grains suitable for use for this purpose in the illustrated embodiment may be selected from the group consisting of a diamond abrasive grain and a CBN (cubic boron nitride). The ultra-hard abrasive grain may be fixed on the surface 12 of the base member 25 by means of a metal bond, a vitreous bond, a resin bond or the like in a manner to be slightly exposed from a surface of a layer of the bond, resulting in providing the micro-cutting surface 26.

The inventor took notice of the fact that a grain size of the ultra-hard abrasive grain above a coarse grain size (hundreds of microns) causes both a surface grain size of a processed surface or a surface of the processed material which has been subject to processing and a depth of a crack layer of the processed surface to be increased to a degree sufficient to render the processed surface coarse, resulting in re-finishing or re-processing of the processed surface being required. Also, it was found that a grain size of the abrasive grain below submicrons causes processing of the processed material such as grinding thereof or the like to be highly deteriorated in efficiency. Thus, a grain size of the ultra-hard abrasive grain is set to be between a coarse grain size and submicrons and preferably between 1 $\mu$m and 30 $\mu$m.

Figure 7:
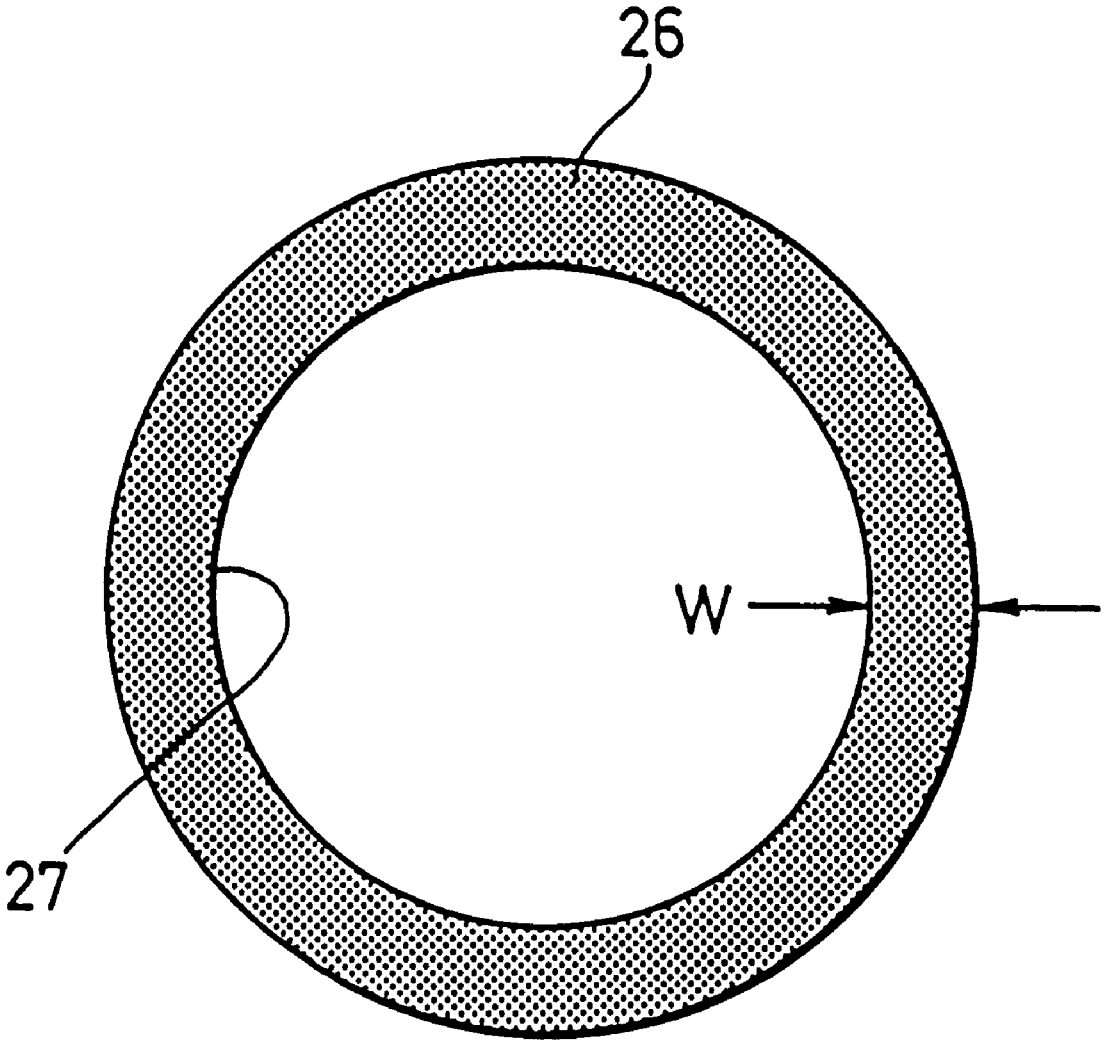
FIG. 7 is a bottom view showing a processing member.
Figure 8:
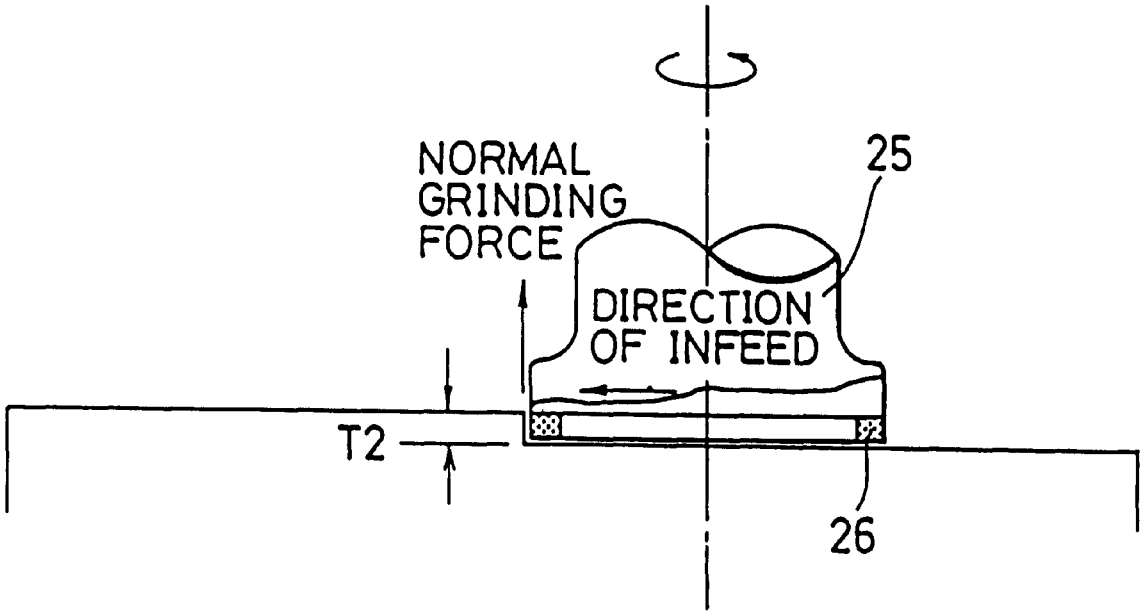
FIG. 8 is a schematic end view showing processing of a processed material by a processing tool.
Figure 9:
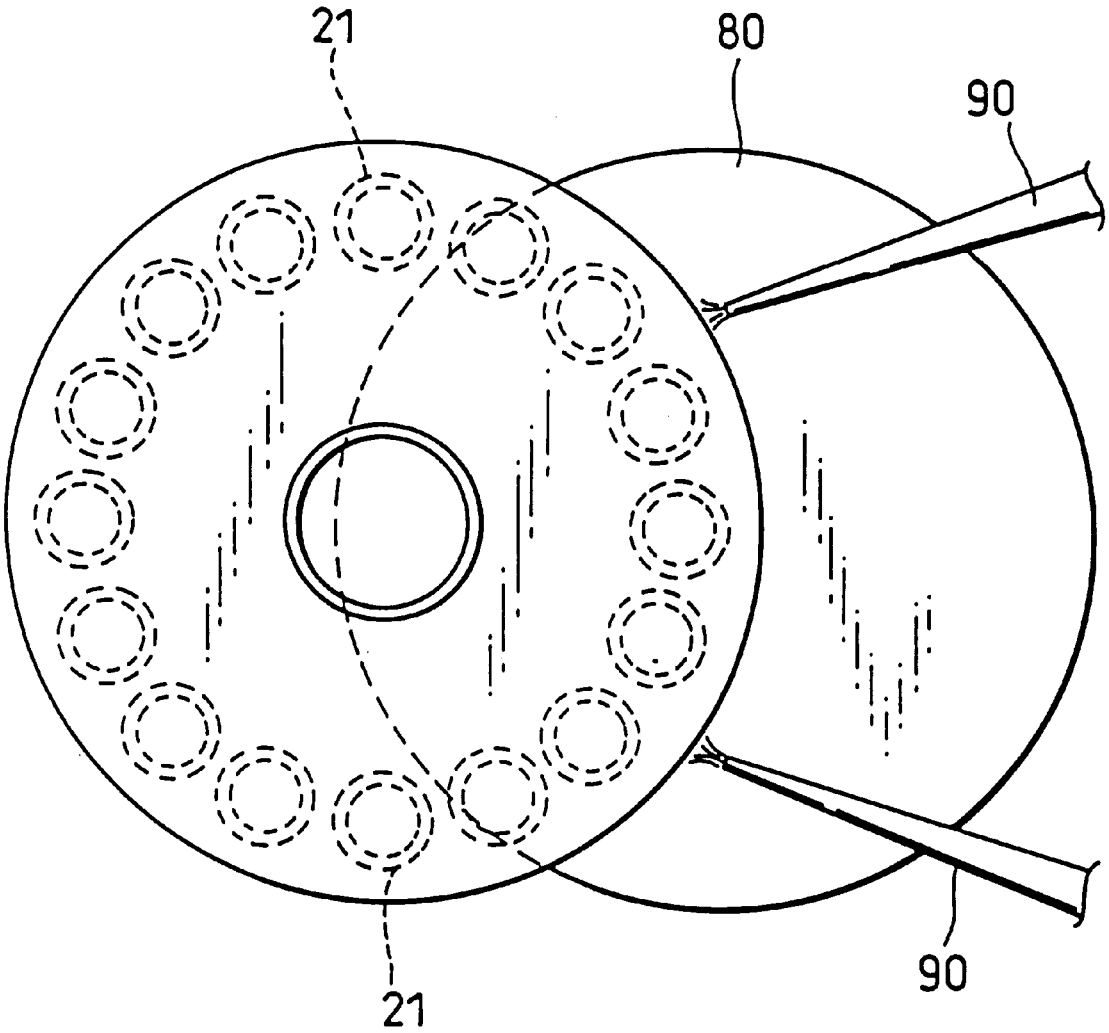
FIG. 9 is a schematic plan view showing infeed of a silicon substrate by a plurality of processing members while feeding processing liquid from nozzles.
Figure 10:
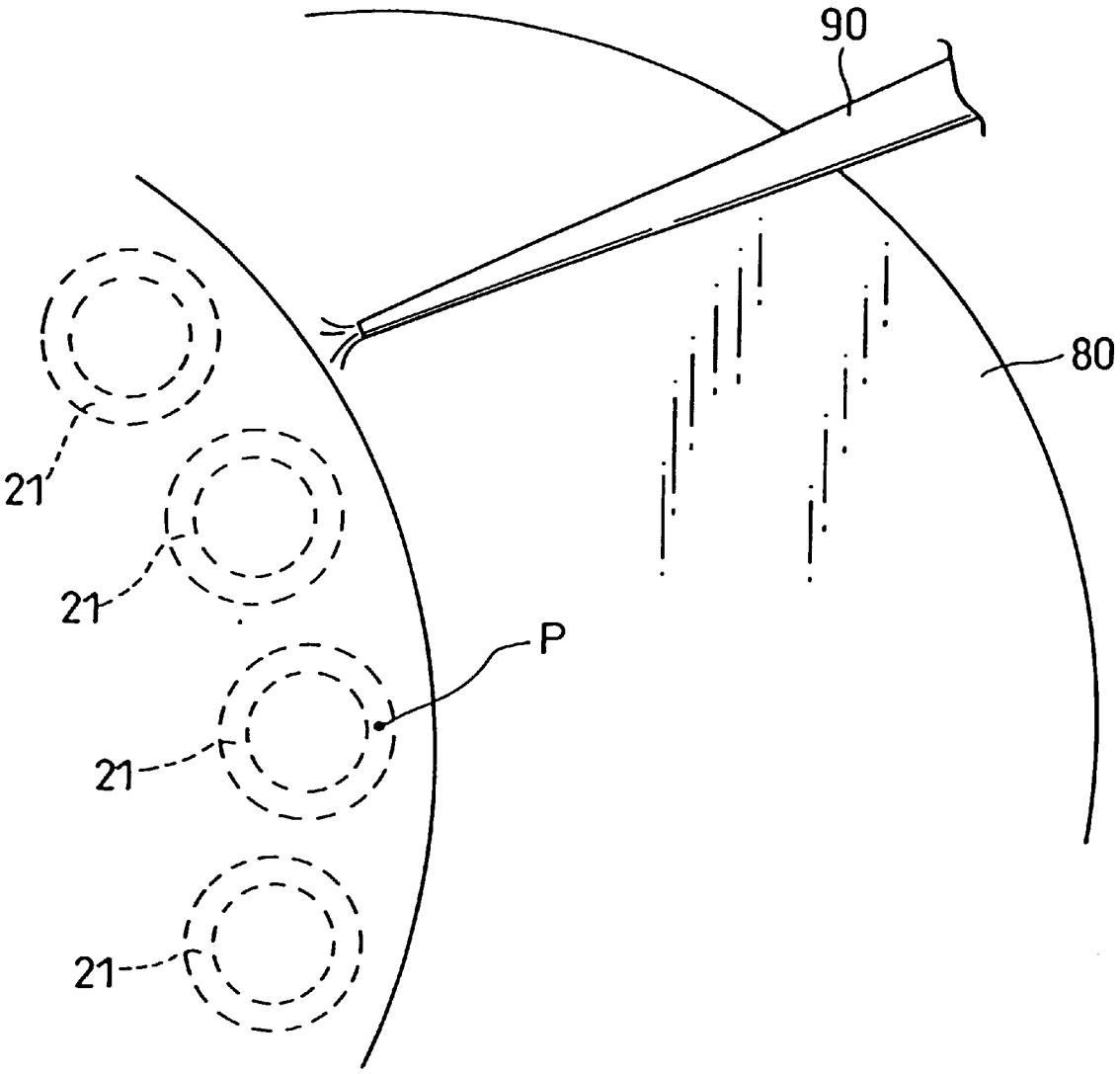
FIG. 10 is a schematic fragmentary enlarged view showing an essential part of FIG. 9.

The micro-cutting surface 26 of the processing member 21 is formed into a wheel-like shape of a predetermined width of about 1 to 3 mm and the base member 25 is formed at a center of a bottom thereof with a recess 27 as shown in FIG. 7. Such construction permits both processing force and the number of times of dressing to be reduced.

The vibration means 30 includes an ultrasonic vibrator 32 constructed of a piezoelectric element to subject the processing member 21 to ultrasonic vibration in directions of the processed material arranged between the processing member 21 and the base 10. Also, the vibration means 30 includes a horn 33 made of titanium and constructed so as to amplify a vibration amplitude of the ultrasonic vibrator 32. The piezoelectric element 32 and horn 33 are received in a spindle 31. Reference numeral 34 (FIG. 5) designates a feeder brush.

Figure 6:
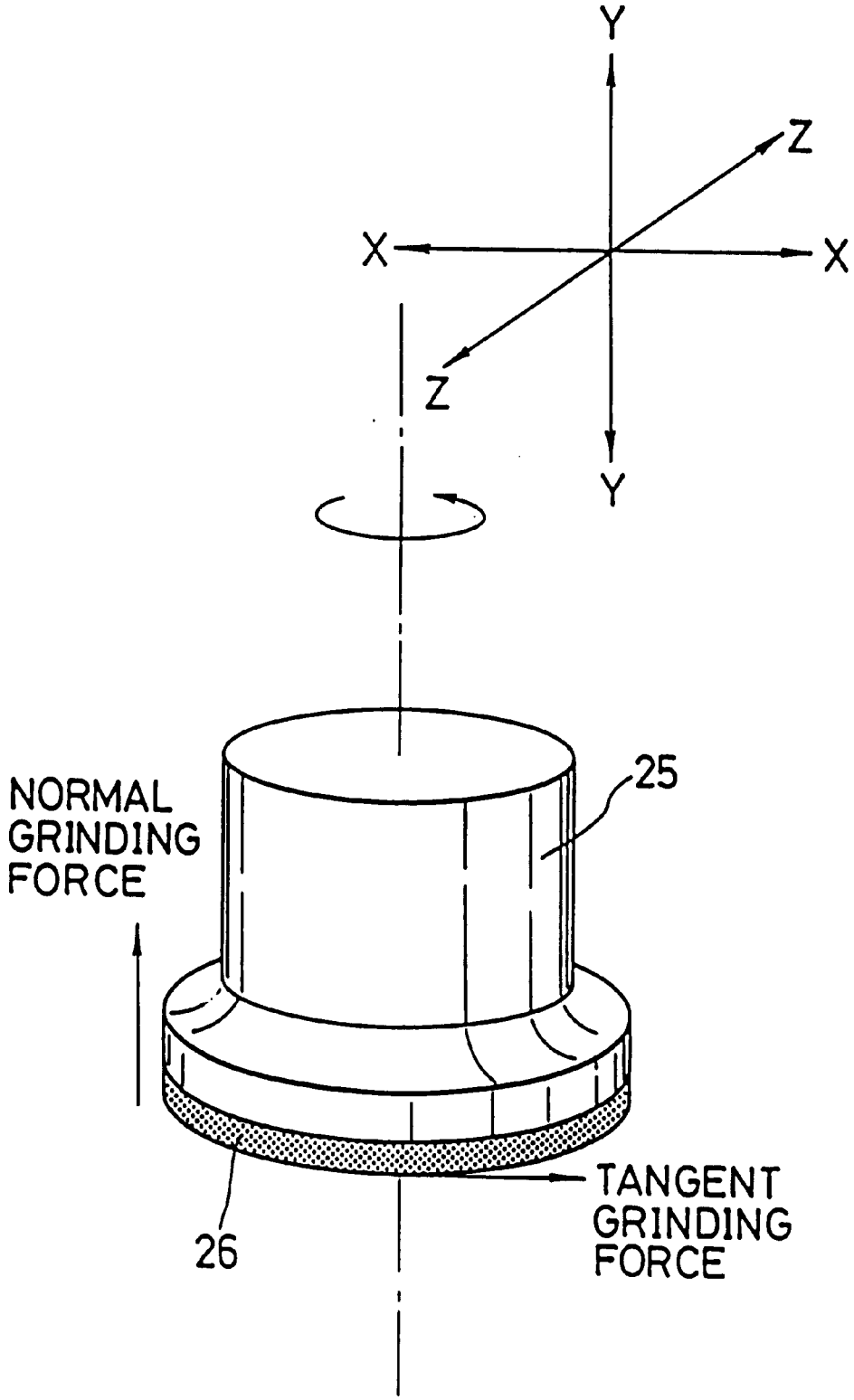
FIG. 6 is an expanded perspective view showing a lower half of a wheel section of a processing member.

The vibration means 30 acts to subject the processing member 21 mounted on a rotation shaft (not shown) to ultrasonic vibration in each of the directions of the processed material or each of X—X, Y—Y and Z—Z directions in FIG. 6. Also, the vibration means 30 acts to ensure injection or feed of processing liquid and process the processed material or brittle material little by little. Application of ultrasonic vibration to the processing member 21 may be carried out by means of ultrasonic wave or static pressure air of the motor incorporation type.

An increase in vibration frequency of the vibration means 30 permits the vibration means 30 to be small-sized correspondingly. However, a vibration frequency of the vibration means 30 above 100 kHz fails to permit a current technical level in the art to accomplish satisfactory small-sizing of the vibration means 30. Also, the vibration frequency below 20 kHz leads to any noise because it falls within an audible zone or band. Thus, a vibration frequency of the vibration means 30 may be suitably set to be within a range between 20 kHz and 100 kHz.

The revolving shaft 40 is rotatably driven by the first drive motor 50 and the processing member 21 is rotatably driven by a second drive motor 60. Between the base 10 and the processing member 21 is interposedly arranged a bearing 70 as shown in FIGS. 1 and 3.

Thus, driving of the base 10 and processing member 21 independent from each other permits both rotation of the processing member 21 on an axis thereof and revolution of the processing member 21 around the base 10 to be carried out.

The base 10 and processing member 21 may be rotated either in the same direction or in directions different from or opposite to each other. The base 10 may be rotated at a rotational speed up to about 10,000 rpm and the processing member 21 may be rotated at a rotational speed between 50 rpm and 5000 rpm.

Now, processing of a processed material by the ultrasonic vibration composite processing tool 1 of the illustrated embodiment thus constructed will be described hereinafter.

The processing may be satisfactorily carried out by injecting processing liquid into the ultrasonic vibration composite processing tool through nozzles 90 while keeping a middle point (W/2) of the micro-cutting surface 26 of a predetermined width constantly abutted against a middle point P (FIG. 10) of the substrate 80. Thus, composite processing of the processed material is carried out while subjecting it to ultrasonic vibration during infeed processing thereof.

The inventor made a processing test using a single processing member constructed in accordance with the illustrated embodiment, wherein a silicon substrate was used as the processes material. The processing member was so constructed that the bottom surface of the base member 25 has a diameter D (FIG. 5) of 42 mm and the micro-cutting surface 26 has a width (FIG. 7) of 1 mm. Also, the micro-cutting surface 26 was formed of a diamond abrasive grain of #3000 (3 to 5 $\mu$m) in grain size. In the test, both ultrasonic vibration composite grinding and grinding without ultrasonic vibration or ultrasonic vibration-free grinding were executed as ultrasonic vibration composite processing and ultrasonic vibration-free processing, respectively. In the ultrasonic vibration composite grinding, a vibration frequency of ultrasonic vibration and a vibration amplitude thereof were set to be 40 kHz and 2 to 3 $\mu$m, respectively. In each of the grindings, both a variation in tangent grinding force to the number of times of infeed and a variation in normal grinding force to the number of times of infeed were measured. Each of both grindings was carried out under the conditions that a rotational speed, a feed rate and an infeed rate are set to be 2000 rpm, 100 mm/min and 1 μm/pass, respectively. The infeed rate means a rate T2 (FIG. 8) at which the micro-cutting surface 26 enters into the silicon substrate.

Figure 11:
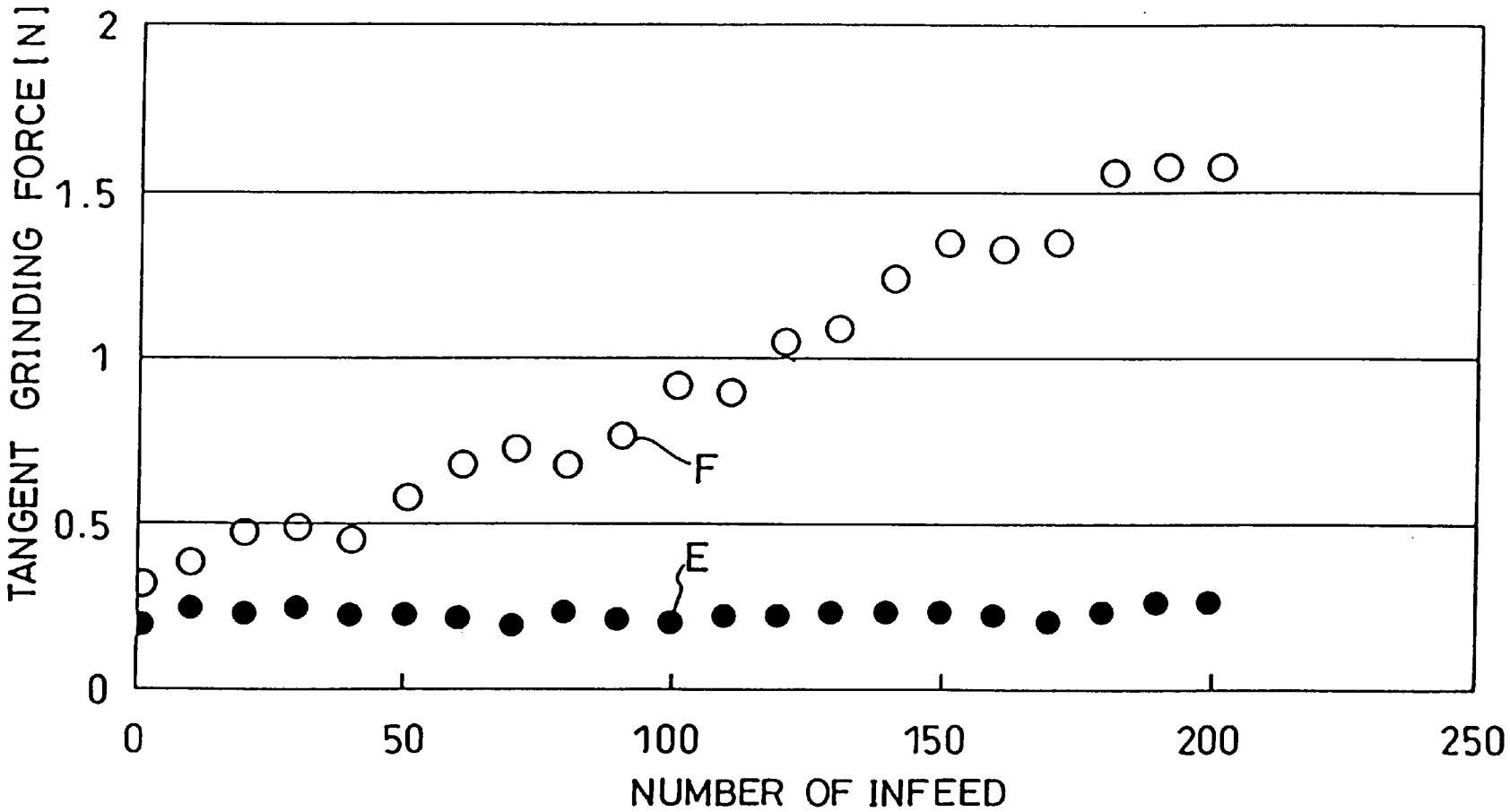
FIG. 11 is a graphical representation showing a variation in tangent processing force to the number of times of infeed when a silicon substrate is processed by means of a single processing member.
Figure 12:
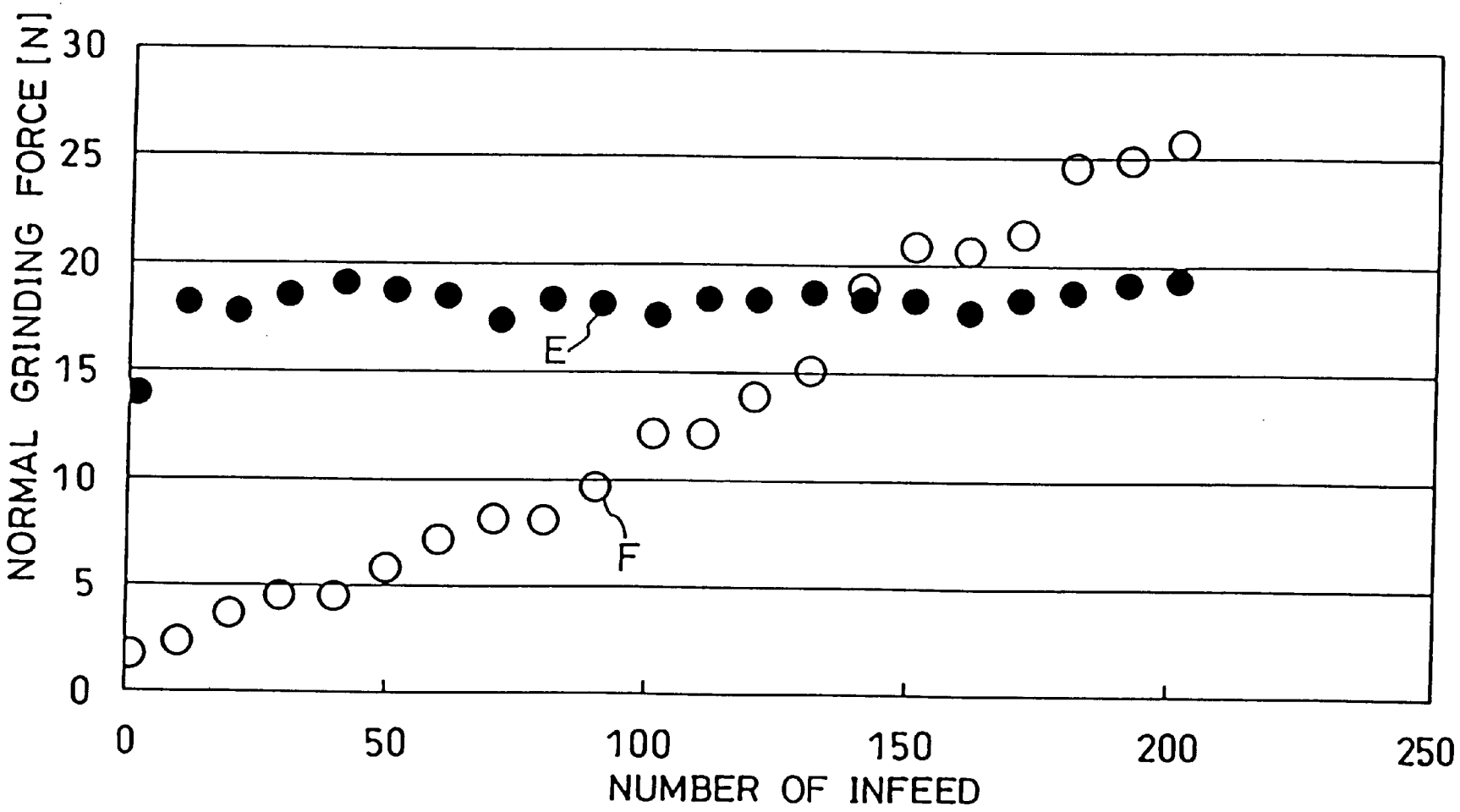
FIG. 12 is a graphical representation showing a variation in normal processing force to the number of times of infeed when a silicon substrate is processed by means of a single processing member.

The results were as shown in FIGS. 11 and 12, wherein ● indicates results of the ultrasonic vibration composite grinding and ○ indicates those of the ultrasonic vibration-free grinding.

Figure 18:
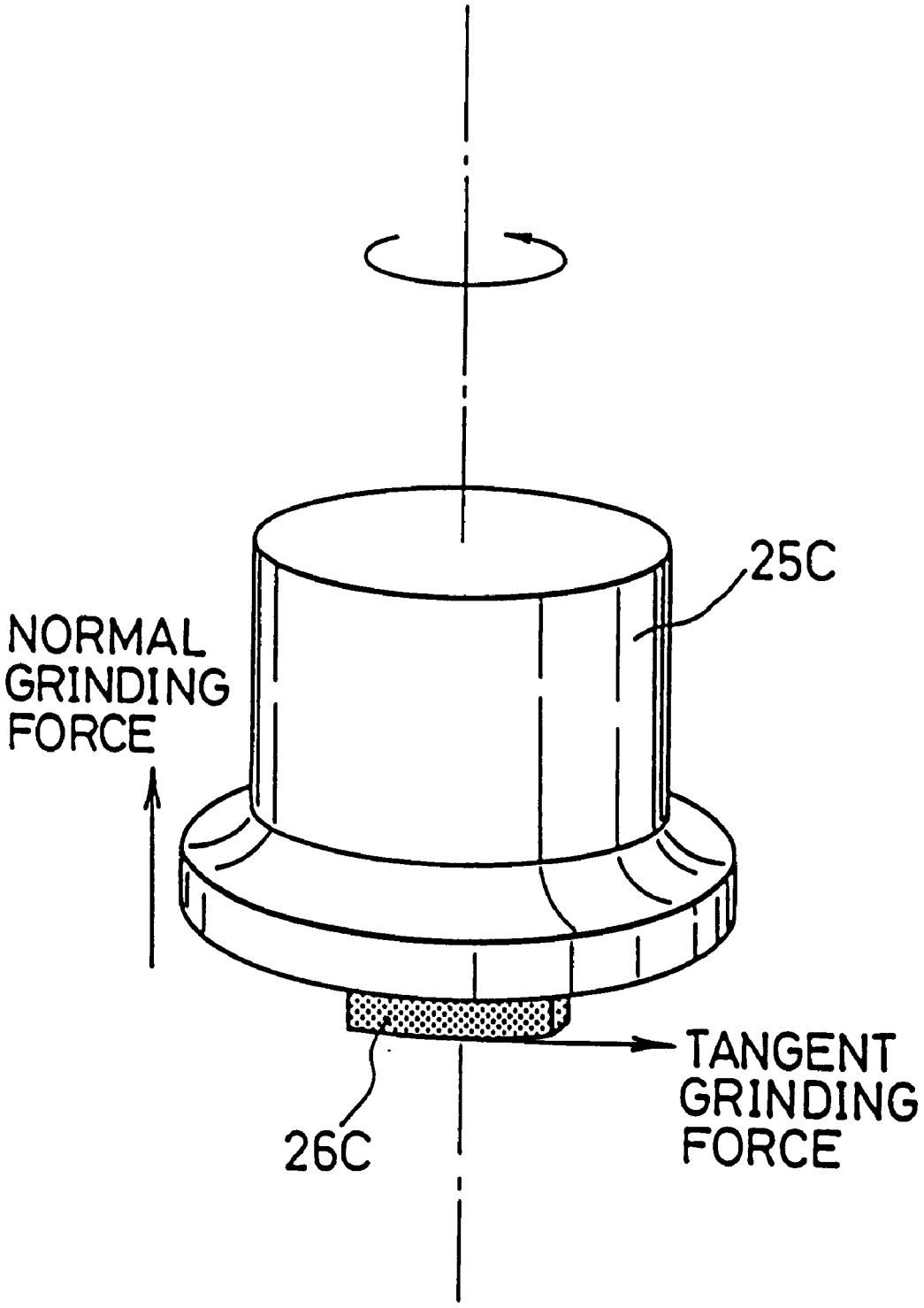
FIG. 18 is a schematic enlarged view showing an essential part of another variation of a micro-cutting surface of a processing member constituting a part of an ultrasonic vibration composite processing tool according to the present invention.

FIGS. 11 and 18 reveal that the ultrasonic vibration composite grinding permitted both tangent grinding force and normal grinding force to be kept substantially constant and minimized the tangent grinding force as indicated at E in FIGS. 11 and 12. On the contrary, the ultrasonic vibration-free grinding caused both tangent grinding force and normal grinding force to be increased with an increase in the number of times of infeed as indicated at F in FIGS. 11 and 12.

Figure 13:
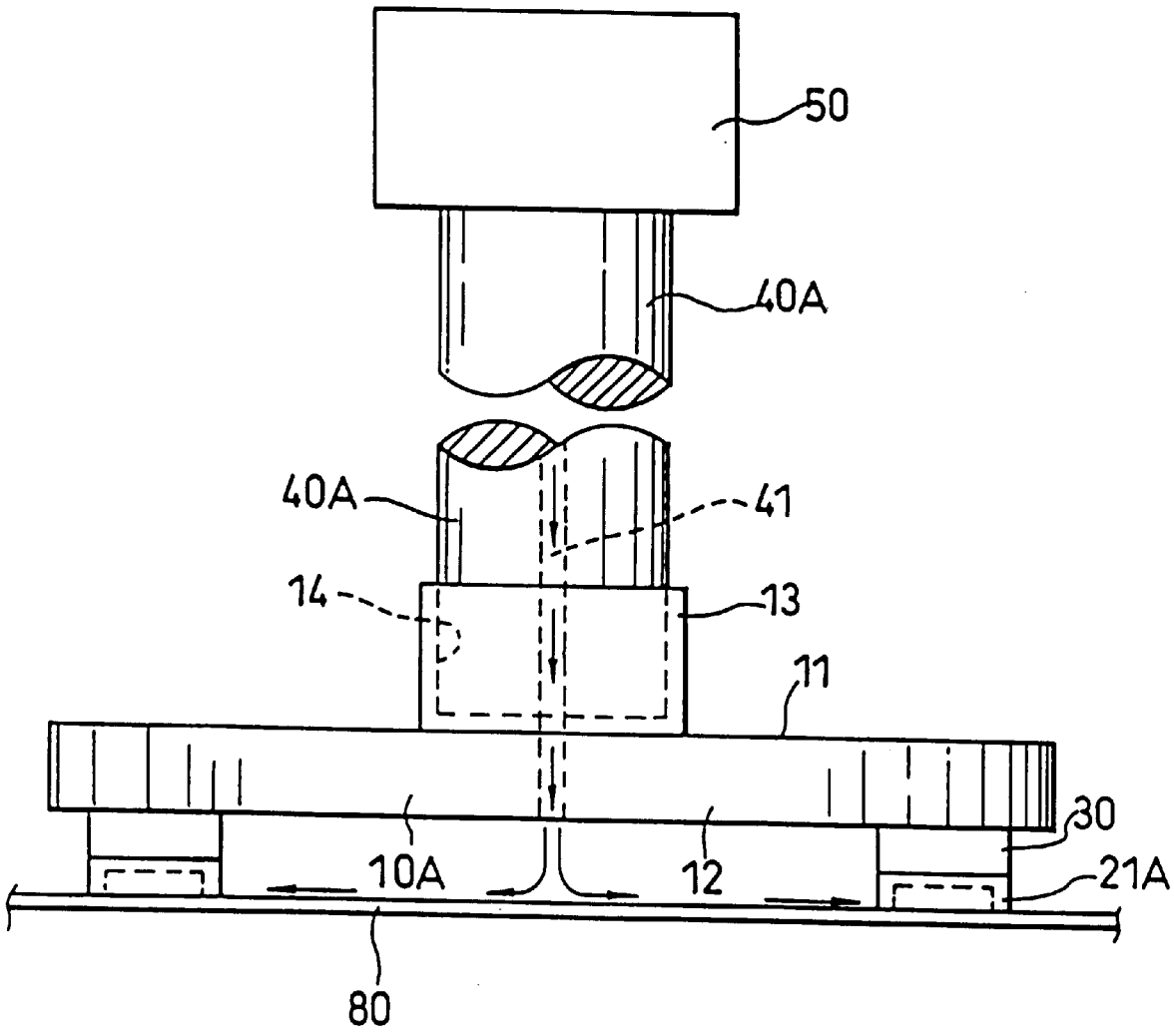
FIG. 13 is a front elevation view showing another embodiment of an ultrasonic vibration composite processing tool according to the present invention.

Referring now to FIG. 13, a second embodiment of an ultrasonic vibration composite processing tool according to the present invention is illustrated. The first embodiment described above is so constructed that the processing member 21 revolves around the base 10 while rotating on the axis thereof. An ultrasonic vibration composite processing tool of the second embodiment is constructed in such a manner that a processing member 21A is fixed on a base 10A so as to be rotated together with the base 10A while eliminating arrangement of the second drive motor 60 and bearing 70 incorporated in the first embodiment described above. Also, in the second embodiment, a revolving shaft 40A and the base 10A are commonly formed with a processing liquid guide hole 41 in a manner to commonly extend through a center of both revolving shaft 40A and base 10A. Such construction permits processing liquid to be fed through the processing liquid guide hole 41 to the processing member 21A. The remaining part of the second embodiment may be constructed in substantially the same manner as the first embodiment.

Figure 14:
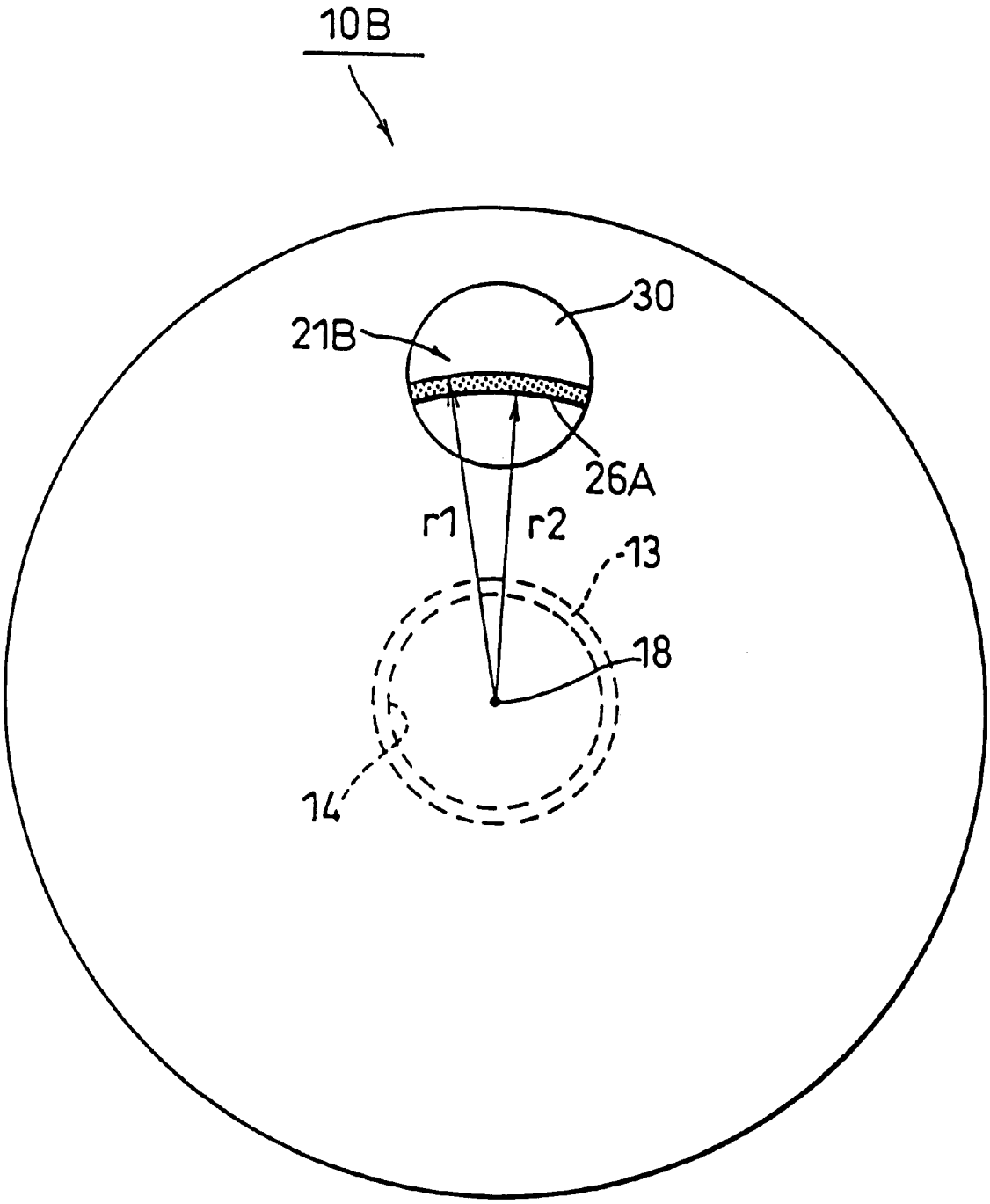
FIG. 14 is a front elevation view showing an essential part of a further embodiment of an ultrasonic vibration composite processing tool according to the present invention, which includes a single processing member.
Figure 15:
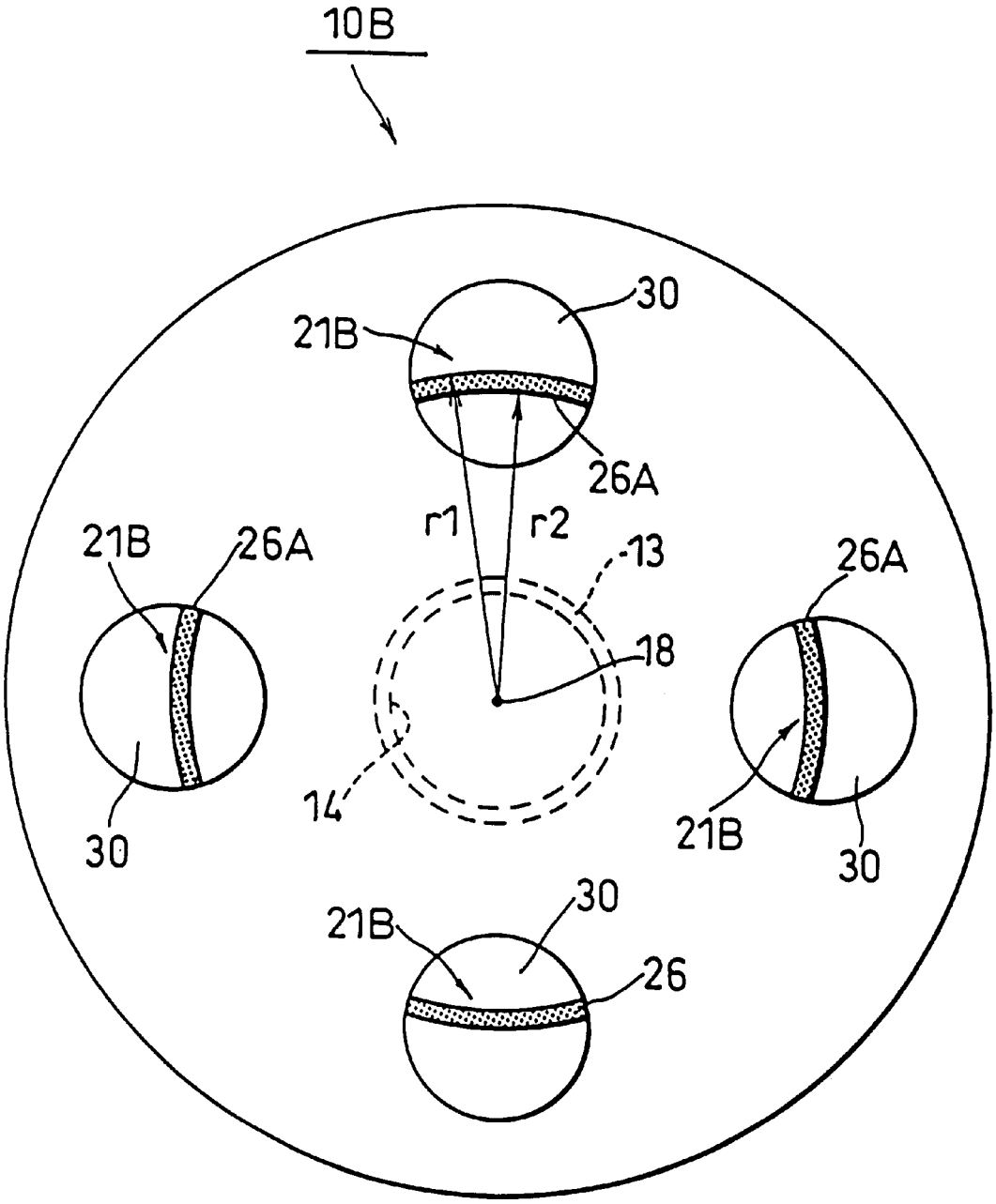
FIG. 15 is a front elevation view showing an essential part of still another embodiment of an ultrasonic vibration composite processing tool according to the present invention, which includes a plurality of processing members.

Referring now to each of FIGS. 14 and 15, a third embodiment of an ultrasonic vibration composite processing tool according to the present invention is illustrated. An ultrasonic vibration composite processing tool of the third embodiment is constructed in substantially the same manner as the above-described second embodiment in that a processing member 21B is fixed on a base 10B so as to be rotated together with the base 10B while eliminating arrangement of the second drive motor 60 and bearing 70 incorporated in the first embodiment.

However, the third embodiment is different from the second embodiment in that in a processing tool of FIG. 14, a single processing member 21B is formed into a curved strip-like shape defined between arcs of different radii r1 and r2 (r2<r1) about a rotation axis 18 of the rotatable base 10B and in a processing tool of FIG. 15, a plurality of processing members 21B each are formed into a curved strip-like shape defined between arcs of radii r1 and r2 (r2<r1) about a rotation axis 18 of the rotatable base 10B. In FIG. 15, four such processing members 21B are arranged. Thus, the micro-cutting surface 26A of each processing member 21B has a curved shape having first and second opposed arcuate segments having different radii of curvature from the rotation axis 18 of the base 10B.

Figure 16:
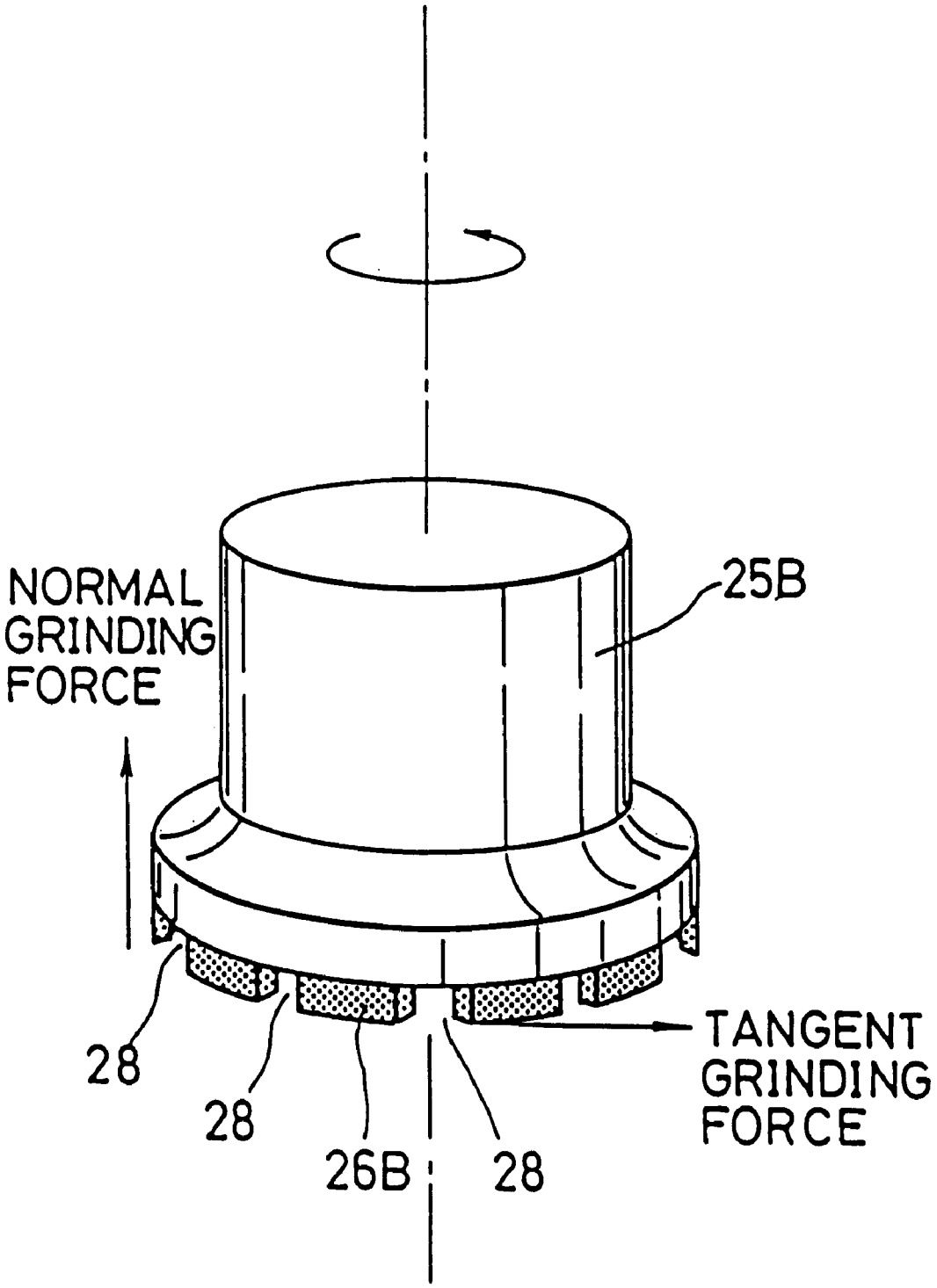
FIG. 16 is a schematic enlarged view showing an essential part of a variation of a micro-cutting surface of a processing member constituting a part of an ultrasonic vibration composite processing tool according to the present invention.
Figure 17:
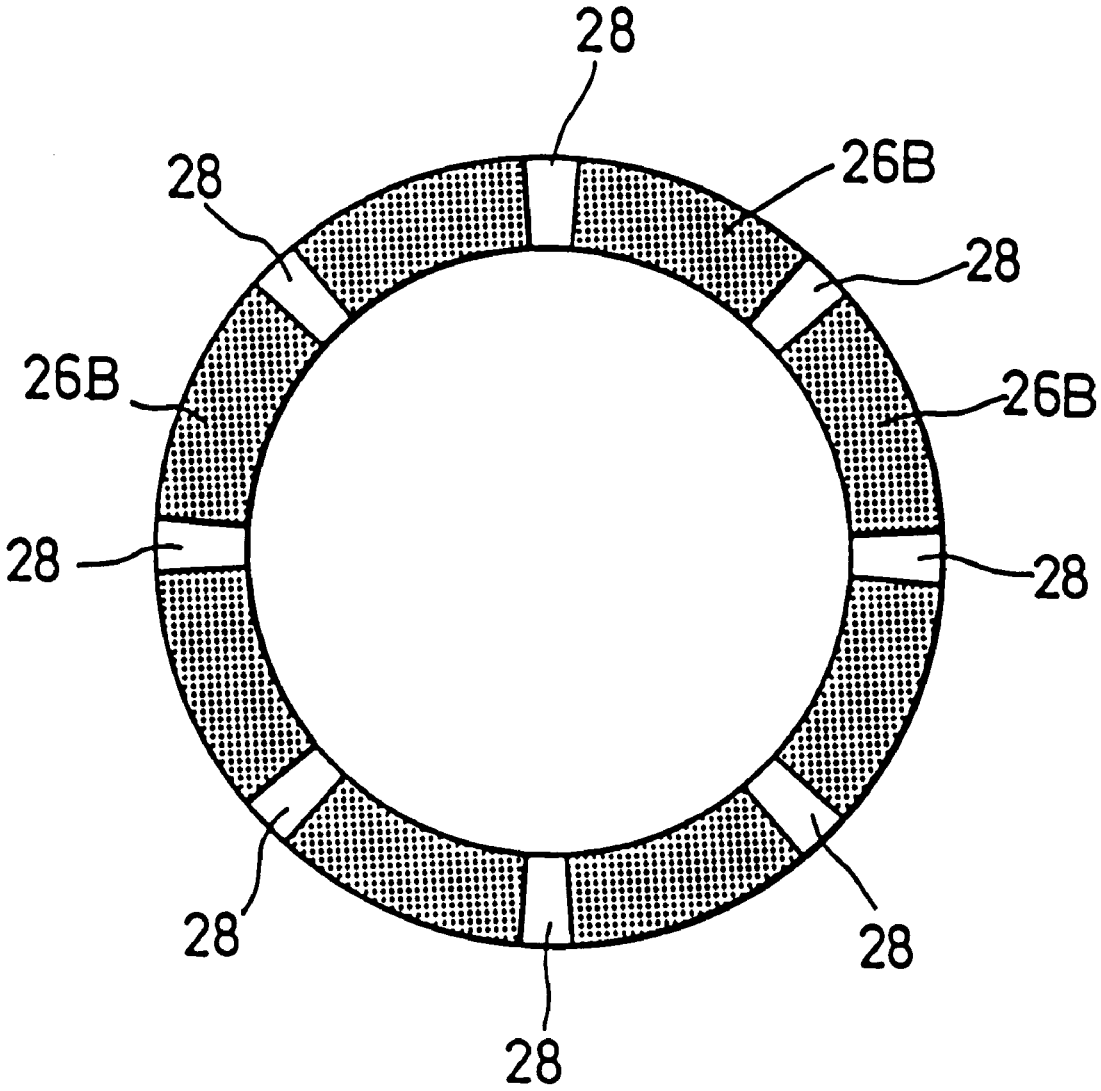
FIG. 17 is a bottom view of the processing member shown in FIG. 16.

Referring now to FIGS. 16 and 17, a variation of the micro-cutting surface of the processing member of the processing means is illustrated. In the variation, a micro-cutting surface 26B of a base member 25B of a processing member 21B is formed thereon with grooves 28 in a manner to be spaced from each other at equal intervals. Such construction of the variation permits both feed and discharge of processing liquid with respect to the micro-cutting surface 26B during processing to be more smoothly accomplished.

Figure 19:
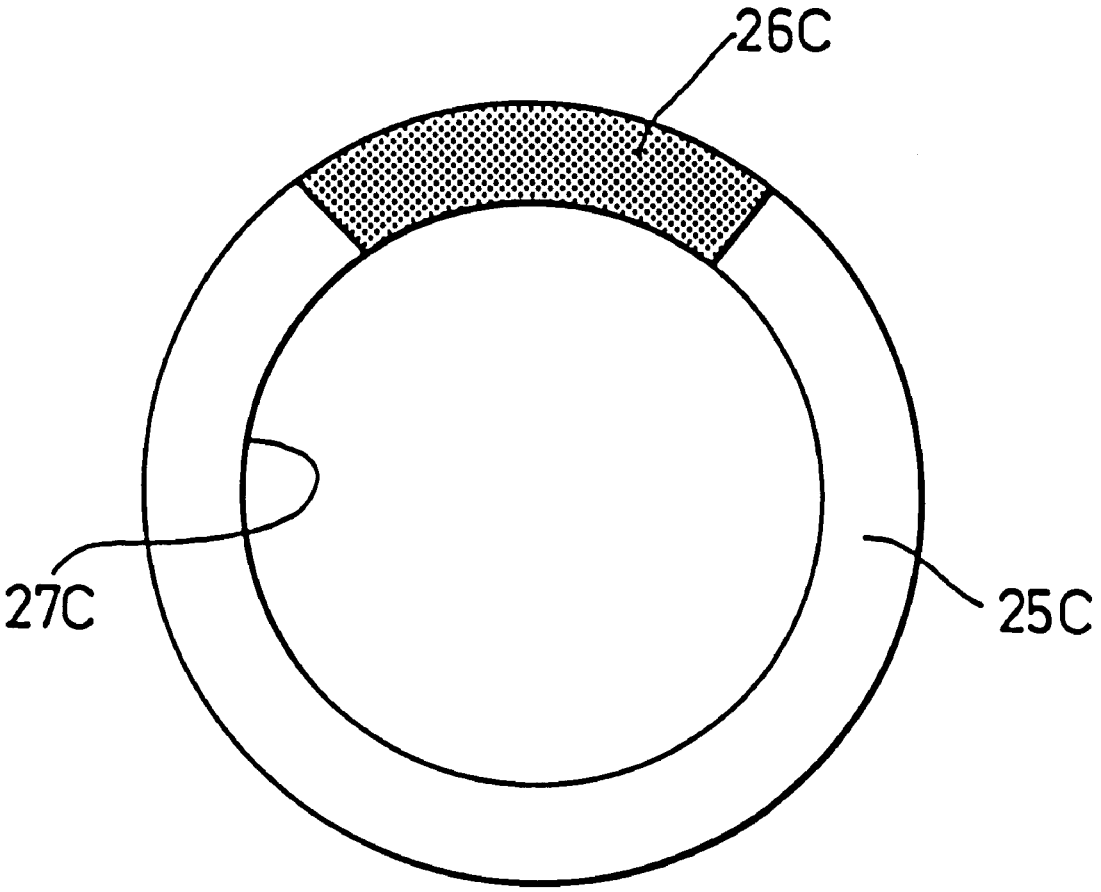
FIG. 19 is a bottom view of the processing member shown in FIG. 18.

Referring now to FIGS. 18 and 19, another variation of the micro-cutting surface of the processing member 21 of the processing means 20 is illustrated. In the variation, a micro-cutting surface 26C is formed on only a part of a bottom or lower surface of a base member 25C. Reference character 27C designates a recess. Such construction of the variation permits tangent processing force to be further reduced.

As can be seen from the foregoing, the ultrasonic vibration composite processing tool of the present invention is so constructed that at least one processing member is arranged for carrying out processing of a processed material while applying vibration to the processed material. Such construction ensures stable operation of the processing means to accomplish efficient processing of the processed material even when the processed material is large-sized.

Also, it ensures satisfactory processing of the processed material into any predetermined or desired size by infeed and provides a surface of the processed material which has been processed with satisfactory surface properties while minimizing generation of a surface defect such as a crack, a pit or the like on the surface of the processed material, so that the processing tool may exhibit increased processing accuracy sufficient to accomplish uniform finishing of the surface.

Further, it restrains a variation in tangent processing force and normal processing force, to thereby keep the forces substantially constant and minimizes tangent processing force to a degree sufficient to reduce abrasion of the micro-cutting surface, to thereby eliminate dressing, resulting in ensuring processing of the processed material into a desired size by infeed.

While preferred embodiments of the invention have been described with a certain degree of particularity with reference to the accompanying drawings, obvious modifications and variations are possible in light of the above teachings. It is therefore to be understood that within the scope of the appended claims, the invention may be practiced otherwise than as specifically described.

What is claimed is:

1. An ultrasonic vibration composite processing tool comprising:

a processing means including a base arranged in a rotatable manner and at least one processing member;

said base having a rotation axis and being arranged so as to be rotatable about said rotation axis;

said base being mounted on a revolving shaft, said processing member including a micro-cutting surface;

said processing member being arranged on one surface of said base so as to be positioned in a circumferential direction of said base about said rotation axis of said base;

a vibration means for vibrating said processing member in directions of a processed material, said vibration means being interposed between said processing member and said base;

a first drive motor for rotatable driving said revolving shaft;

a second drive motor for rotatably driving said processing member; and a bearing interposed between said base and said processing member;

said processing member being rotated by said second drive motor and vibrated by said vibration means during processing to cause said micro-cutting surface of said processing member to contact the processed material and thereby subject the processed material to composite processing.

2. An ultrasonic vibration composite processing tool as defined in claim 1, wherein said processing means includes a plurality of said processing members;

said processing members each being formed into an identical configuration;

said processing members being arranged on said one surface of said base in a manner to be spaced from each other at predetermined intervals about said rotation axis of said base in a circumferential direction of said base.

3. An ultrasonic vibration composite processing tool as defined in claim 1, wherein said vibration means is interposed between said processing member and said base.

4. An ultrasonic vibration composite processing tool as defined in claim 3, wherein said revolving shaft and base are formed therein with a processing liquid guide hole in a manner to commonly extend through a center of both revolving shaft and base, resulting in processing liquid being fed through said processing liquid guide hole.

5. An ultrasonic vibration composite processing tool as defined in claim 1, wherein said processing member includes a base member connected to said vibration means and said micro-cutting surface is formed on a lower surface of said base member.

6. An ultrasonic vibration composite processing tool as defined in claim 5, wherein said micro-cutting surface is formed by embedding an ultra-hard abrasive grain in said lower surface of said base member;

said ultra-hard abrasive grain having a grain size between a coarse grain size and submicrons;

said ultra-hard abrasive grain being selected from the group consisting of a diamond abrasive grain and a CBN abrasive grain.

7. An ultrasonic vibration composite processing tool as defined in claim 5, wherein said vibration means includes an ultrasonic vibrator interposed between said processing member and said base to subject said processing member to ultrasonic vibration in the directions of the processed material and a horn for amplifying a vibration amplitude of said ultrasonic vibrator.

8. An ultrasonic vibration composite processing tool as defined in claim 5, wherein said micro-cutting surface of said base member of said processing member is formed thereon with grooves in a manner to be spaced from each other at equal intervals.

9. An ultrasonic vibration composite processing tool as defined in claim 5, wherein said micro-cutting surface is formed on only a part of said lower surface of said base member.

10. An ultrasonic vibration composite processing tool as defined in claim 1, wherein said micro-cutting surface of said processing member is formed into a curved shape having first and second opposed arcuate segments such that said first arcuate segment has a different radius of curvature from said rotation axis of said base than a radius of curvature of said second arcuate segment from said rotation axis of said base.

11. An ultrasonic vibration composite processing tool comprising:

a processing means including a base arranged in a rotatable manner and a plurality of processing members;

said base having a rotation axis and being arranged so as to be rotatable about said rotation axis;

said processing members each including a micro-cutting surface and being formed into an identical shape, said micro-cutting surface of each of said processing members being formed in a curved shape having first and second opposed arcuate segments such that said first arcuate segment has a different radius of curvature from said rotation axis of said base than a radius of curvature of said second arcuate segment from said rotation axis of said base;

said processing members being arranged on one surface of said base in a manner to be spaced from each other at predetermined intervals in a circumferential direction of said base about said rotation axis of said base; and a vibration means for vibrating each of said processing members in directions of a processed material;

said base and thus said processing members being rotated, and said processing members being vibrated by said vibration means during processing to cause said micro-cutting surface of each of said processing members to contact the processed material and thereby subject the processed material to composite processing.

12. An ultrasonic vibration composite grinding tool comprising:

a grinding means including a base supportedly mounted on a revolving shaft in a rotatable manner and a plurality of grinding wheels;

said base having a rotation axis and being arranged so as to be rotatable about said rotation axis;

said grinding wheels each including a micro-cutting surface and being formed into an identical configuration;

said grinding wheels being arranged on one surface of said base in a manner to be spaced from each other at predetermined intervals about said rotation axis of said base in a circumferential direction of said base; and a vibration means arranged between said grinding wheels and said base for vibrating said grinding wheels in directions of a ground material;

said base and thus said grinding wheels being rotated, and said grinding wheels being vibrated by said vibration means during processing to cause said micro-cutting surface of each of said grinding wheels to contact the ground material and thereby subject the ground material to composite grinding.

13. An ultrasonic vibration composite grinding tool comprising:

a grinding means including a base supportedly mounted on a revolving shaft in a rotatable manner and a plurality of grinding wheels;

said base having a rotation axis and being arranged so as to be rotatable about said rotation axis;

said grinding wheels each including a micro-cutting surface and being formed into an identical configuration;

said grinding wheels being arranged on one surface of said base in a manner to be spaced from each other at predetermined intervals about said rotation axis of said base in a circumferential direction of said base;

a vibration means arranged between said grinding wheels and said base for vibrating said grinding wheels in directions of a ground material;

a first drive motor for driving said revolving shaft;

a second drive motor for driving said grinding wheels; and a bearing interposed between said base and said grinding wheels;

said grinding wheels being rotated by said second drive motor and vibrated by said vibration means during processing to cause said micro-cutting surface of each of said grinding wheels to contact the ground material and thereby subject the ground material to composite grinding.

14. An ultrasonic vibration composite processing tool comprising:

a processing means including a base arranged in a rotatable manner and a processing member;

said base having a rotation axis and being arranged so as to be rotatable about said rotation axis;

said processing member including a micro-cutting surface, said micro-cutting surface of said processing member being formed in a curved shape having first and second opposed arcuate segments such that said first arcuate segment has a different radius of curvature from said rotation axis of said base than a radius of curvature of said second arcuate segment from said rotation axis of said base;

said processing member being arranged on one surface of said base so as to be positioned in a circumferential direction of said base about said rotation axis of said base; and a vibration means for vibrating said processing member in directions of a processed material, said base and thus said processing member being rotated, and said processing member being vibrated by said vibration means during processing to cause said micro-cutting surface of said processing member to contact the processed material and thereby subject the processed material to composite processing.

* * * * *